United States Patent [19]

Ferguson

[11] Patent Number: 4,605,375

[45] Date of Patent: Aug. 12, 1986

[54] TRIM AND TILT CONTROL FOR MARINE PROPULSION DEVICES

[75] Inventor: Arthur R. Ferguson, Northbrook, Ill.

[73] Assignee: Outboard Marine Corporation, Waukegan, Ill.

[21] Appl. No.: 574,582

[22] Filed: Jan. 27, 1984

[51] Int. Cl.[4] ..... B63H 21/26

[52] U.S. Cl. ..... 440/1; 440/61

[58] Field of Search ..... 440/1, 53, 61, 900; 248/642

[56] References Cited

U.S. PATENT DOCUMENTS

| | | | |
|---|---|---|---|
| 3,406,652 | 10/1968 | Mettetal, Jr. | 115/41 |
| 3,434,449 | 3/1969 | North | 115/41 |
| 3,581,702 | 1/1971 | Moberg | 115/41 |
| 3,641,965 | 2/1972 | Schmiedel | 440/2 |
| 3,722,455 | 3/1973 | Carpenter | 115/41 |
| 3,834,345 | 9/1974 | Hager et al. | 115/41 |
| 3,863,592 | 2/1975 | Borst | 115/17 |
| 3,885,517 | 5/1975 | Borst et al. | 115/41 |
| 3,894,250 | 7/1975 | Hager et al. | 307/309 |
| 4,064,824 | 12/1977 | Hall et al. | 115/41 |
| 4,096,820 | 6/1978 | Hall | 115/41 |
| 4,318,699 | 3/1982 | Wenstadt et al. | 440/1 |
| 4,373,921 | 2/1983 | Hall et al. | 440/61 |
| 4,413,215 | 11/1983 | Cavil et al. | 318/558 |

*Primary Examiner*—Sherman D. Basinger
*Assistant Examiner*—Thomas J. Brahan
*Attorney, Agent, or Firm*—Michael, Best & Friedrich

[57] ABSTRACT

The electrical control for a hydrau' 'lly-actuated trim and tilt system of a marine propulsion device includes a trim-tilt switch movable between "off", "up" and "down" positions, a motion-actuated position switch movable from a "trim" position to a "tilt" position in response to a tiltable propulsion assembly being pivoted upwardly beyond the upper end of a range of trim positions, a pressure-actuated thrust switch which senses an increase in the hydraulic pressure in part of the hydraulic system due a placement of the piston of the hydraulic actuator under load in response to increasing propelling thrust and which is movable from a "low" thrust position to a "high" thrust position in response to the hydraulic pressure exceeding a predetermined level corresponding to a predetermined propeller thrust level, and a reversible electrical motor driving a reversible hydraulic pump which supplies pressurized hydraulic fluid to the hydraulic actuator. The switches, an electrical source, and the motor are electrically interconnected such that the pump is operated to cause downward pivotal movement of the propulsion assembly in response to movement of the trim-tilt switch to the "down" position, to cause upward pivotal movement of the propulsion assembly in response to movement of the trim-tilt switch to the "up" position, except when the position switch is in the "tilt" position and the thrust switch is in the "high" thrust position, and to cause downward pivotal movement of the propulsion assembly when the position switch is in the "tilt" position and the thrust switch is in the "high" thrust position irrespective of the position of the trim-tilt switch.

33 Claims, 3 Drawing Figures

TRIM AND TILT CONTROL FOR MARINE PROPULSION DEVICES

BACKGROUND OF THE INVENTION

This invention relates generally to marine propulsion devices, such as outboard motors and stern drive units, including a vertically tiltable propulsion assembly supporting a propeller. More particularly, this invention relates to means for controlling the trim and tilt systems of such marine propulsion devices.

Marine propulsion devices typically include one or more hydraulically actuated cylinders for vertically trimming and/or tilting a lower unit carrying a propeller to desired angular positions. Operation of these cylinders usually is controlled by a manually operable switch which is movable between three positions, neutral or "off", "up" and "down". The switch is operated to trim the propeller position during boat operation. Trimming is carried out over a range of positions from a full down position to an upper limit of approximately 10°–15° above the full down position. This changes the angle of propeller thrust which causes the boat to raise or lower, thereby enabling selection of the proper and/or most efficient propeller thrust angle for different loads, different water conditions and boat planing. The lower unit is tilted or raised above the trim range into the tilt range to insure clearance when boating in shallow water and facilitate launching or trailering.

When separate hydraulic cylinders are used to perform the trim and tilt functions, the actuation system for each can be selectively hydraulically isolated to prevent actuation of the tilt cylinder(s) while operating at relatively high engine speeds and thereby prevent potentially harmful engine overspeeding under low load or no load conditions. When a single hydraulic cylinder and/or a plurality of hydraulic cylinders acting in parallel is used to provide both trimming and tilting, the operation of the cylinder(s) in the trim and tilt ranges has not been hydraulically separated, so a different type of control is required.

Examples of prior art trim and/or tilt controls are disclosed in the following U.S. patents:

| Patentee | U.S. Pat. No. | Issue Date |
|---|---|---|
| Mettelal | 3,406,652 | October 22,1968 |
| North | 3,434,449 | March 25, 1969 |
| Moberg | 3,581,702 | June 1, 1971 |
| Carpenter | 3,722,455 | March 27, 1973 |
| Hager | 3,834,345 | September 10, 1974 |
| Borst | 3,863,592 | February 4, 1975 |
| Borst | 3,885,517 | May 27, 1975 |
| Hager | 3,894,250 | July 8, 1975 |
| Hall | 4,064,824 | December 27, 1977 |
| Hall | 4,096,820 | June 27, 1978 |
| Pitchford | 4,318,699 | March 9, 1982 |
| Hall | 4,373,921 | February 15, 1983 |
| Cavil | 4,413,215 | November 1, 1983 |

None of these patents describes a simple means for controlling the operation of a hydraulic cylinder(s) which performs both the trim and tilt functions so that the propulsion assembly can not be raised from a trim position to a tilt position under high propeller thrust conditions and is automatically returned from a tilt position to a trim position under high propeller thrust conditions.

SUMMARY OF THE INVENTION

The invention provides a marine propulsion device, such as an outboard motor or a stern drive unit, comprising a propulsion assembly including a lower unit which carries a rotatably mounted propeller and which is submerged in water when the propulsion unit is in an operating position, means connecting the propulsion assembly to a boat to afford relative pivotal movement of the propulsion assembly in a generally vertical plane, one or more hydraulic cylinders for pivoting the propulsion assembly through a range of trim positions from a fully down, operating position wherein the propeller is fully submerged in the water and also through a range of tilt positions angularly upwardly from the range of trim positions and including a fully raised, non-operating position, a hydraulic fluid system including an electrically operated reversible hydraulic pump which effects movement of the hydraulic cylinder in a first direction to pivot the propulsion assembly downwardly when pumping hydraulic fluid in one direction and which effects movement of the hydraulic cylinder in a second direction to pivot the propulsion assembly upwardly when pumping hydraulic fluid in the opposite direction, and an electrical control for controlling the operation of the pump including a trim-tilt switch movable to a down position to selectively operate the pump, whereby the pump is operated to cause downward pivotal movement of the propulsion assembly in response to movement of the trim-tilt switch to the down position, irrespective of the thrust applied on the propulsion assembly by the propeller or the position of the propulsion assembly other than the fully down, operating position.

In one embodiment, the trim-tilt switch is movable to an up position and the pump is operated to cause upward pivotal movement of the propulsion assembly in response to movement of the trim-tilt switch to the up position when the propeller thrust is below a predetermined level, irrespective of the position of the propulsion assembly, and to cause upward pivotal movement of the propulsion assembly from a trim position to a tilt position in response to movement of the trim-tilt switch to the up position, except when the propeller thrust is above the predetermined level.

In one embodiment, the trim-tilt switch is movable between off, up and down positions and the pump is operated to cause downward pivotal movement of the propulsion assembly from a tilt position to a trim position when the propeller thrust exceeds the predetermined level, irrespective of the position of the trim-tilt switch.

In one embodiment, the electrical control includes a pressure-actuated thrust switch which senses an increase in the hydraulic pressure in part of the hydraulic system due to placement of the piston of the hydraulic cylinder under load by increasing engine thrust and which switches from one position to another switch position in response to the hydraulic pressure exceeding a predetermined level corresponding to the predetermined propeller thrust level.

In one embodiment, the electrical control means includes a motion-actuated position switch which moves from one position switch to another switch position in response to the propulsion assembly being pivoted upwardly past a predetermined angular position.

In another embodiment, the electrical control includes an electrical power source, a trim-tilt switch movable between off, up and down positions, a motion-actuated position switch movable from a trim position to a tilt position in response to the propulsion assembly being pivoted upwardly past the predetermined angular position, a pressure-actuated thrust switch which senses an increase in the hydraulic pressure in part of the hydraulic system due to placement of the piston of the hydraulic cylinder under load by increasing engine thrust and which moves from a low thrust position to a high thrust position in response to the hydraulic pressure exceeding a predetermined corresponding to the predetermined propeller thrust level, an electrical motor for driving the pump, and electrical circuit means interconnecting the power source, the trim-tilt switch, the position switch, the thrust switch and the motor whereby the pump is operated to cause downward pivotal movement of the propulsion assembly in response to movement of the trim-tilt switch to the down position, the pump is operated to cause upward pivotal movement of the propulsion assembly in response to the trim-tilt switch to the up position, except when the position switch is in the tilt position and the thrust switch is in the high thrust position, and the pump is operated to cause downward pivotal movement of the propulsion assembly when the position switch is in the tilt position and the thrust switch is in the high thrust position irrespective of the position of the trim-tilt switch.

One of the principal features of the invention is the provision of an electrical control for a hydraulically actuated trim and tilt system of a marine propulsion device, which control electrically separates the trim and tilt ranges of the hydraulic actuator.

Another of the principal features of the invention is the provision of such a control which is arranged to prevent a tiltable propulsion assembly of a marine propulsion device from being pivoted from a trim position to a tilt position when the propeller thrust is above a predetermined level.

A further of the principal features of the invention is the provision of such a control which is arranged to cause the propulsion assembly to be automatically pivoted from a tilt position to a trim position when the propeller thrust is above the predetermined level.

Other features, aspects and advantages of the invention will become apparent to those skilled in the art upon reviewing the following detailed description, the drawing and the appended claims.

Figure 1:
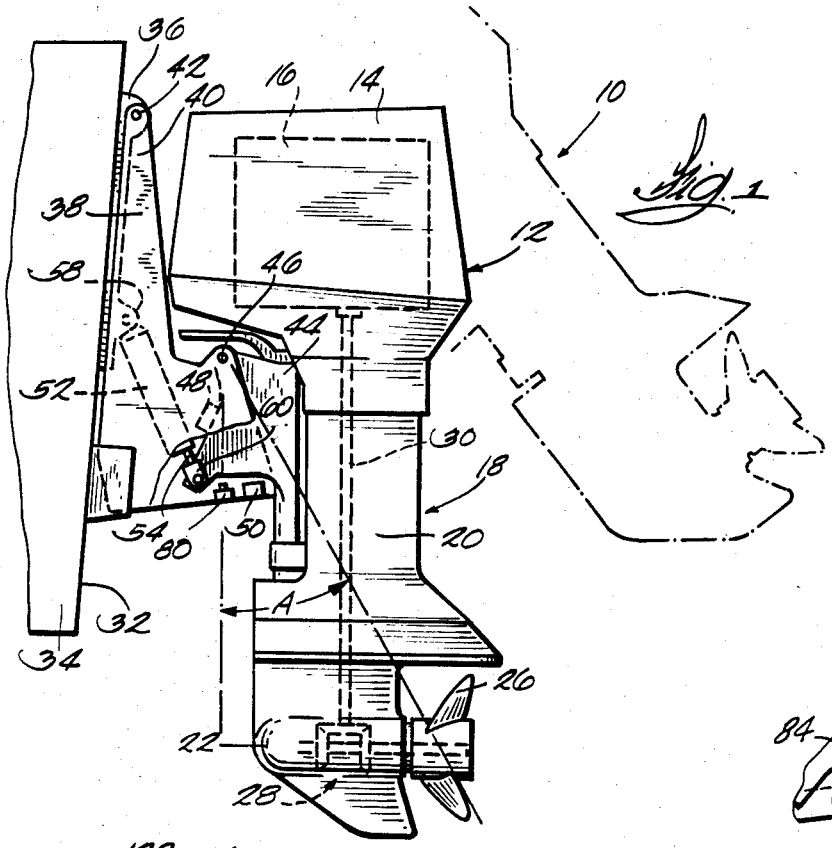
FIG. 1 is a side elevational view of an outboard motor embodying the invention.

Before explaining at least one of the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Illustrated in FIG. 1 is an outboard motor 10 including a propulsion assembly 12 having a power head 14 housing an internal combustion engine 16 and a lower unit 18 affixed to the power head 14. The lower unit 18 includes a drive shaft housing 20 and a lower gear case 22 which supports a rotatable propeller shaft 24 carrying a propeller 26. The gear case 22 houses a suitable transmission 28 which is connected to the engine 16 via a drive shaft 30 which is disposed inside the drive shaft housing 20 and which drives the propeller shaft 24.

The outboard motor 10 includes means mounting the propulsion assembly 12 for pivotal movement in both a horizontal plane and a vertical plane relative to a transom 32 of a boat 34. This pivot means affords steering movement of the propulsion assembly 12 in a horizontal plane as well as movement the propulsion assembly 12 in a vertical plane between a lower operating or full down position wherein the propeller 26 is fully submerged in the water and a non-operating position wherein the propeller 26 raised above the water. While various arrangements can be used, in the specific construction illustrated, such pivot means includes a transom bracket 36 adapted to be fixedly mounted on the boat transom 32 and an intermediate or stern bracket 38 having an upper end 40 mounted on the transom bracket 36 for pivotal movement of the stern bracket 38 about a generally horizontal transverse tilt axis 42. The pivot means for the propulsion assembly 12 further includes a swivel bracket 44 mounted on the stern bracket 38 for relative pivotal movement about a generally horizontal transverse trim axis 46 which is parallel to and located below the tilt axis 42.

Pivotal movement of the swivel bracket 44 relative to the stern bracket 38 about the trim axis 46 is limited by a pair of stops 48 and 50 on the stern bracket 38. The stops 48 and 50 are positioned to be engaged by the swivel bracket 44 and establish a range of trim positions for the propeller 26.

The propulsion assembly 12 is connected to the swivel bracket 44 in the usual manner to provide common movement with the swivel bracket 44 about the trim axis 46 and the tilt axis 42 and to provide steering movement of the propulsion assembly 12 relative to the swivel bracket 44 about a generally vertical axis.

The propulsion assembly 12 can be sequentially pivoted about the trim axis 46 through a range of trim positions and then about the tilt axis 42 through a range of tilt positions up to a fully raised, non-operating position by a pair of hydraulic cylinders 52 mounted side by side and acting in parallel. Only one of the hydraulic cylinders 52 is illustrated in FIG. 1.

Each hydraulic cylinder 52 includes a piston rod 54 connected to a reciprocative piston 56. The cylinder end 58 of the hydraulic cylinder 52 is mounted to the transom bracket 36 and the rod end 60 is pivotally connected to the swivel bracket 44. The pivotal connections of the hydraulic cylinder 52 are located such that, when the lower unit 18 is in the lowermost driving position shown by solid lines in FIG. 1, the mechanical advantage of the propulsion assembly is greater about the tilt axis 42 than about the trim axis 46. Thus, the swivel bracket 44 will pivot about the trim axis 46 until it engages the stop 50 before the stern bracket 38 starts pivoting about the tilt axis 42.

Figure 3:
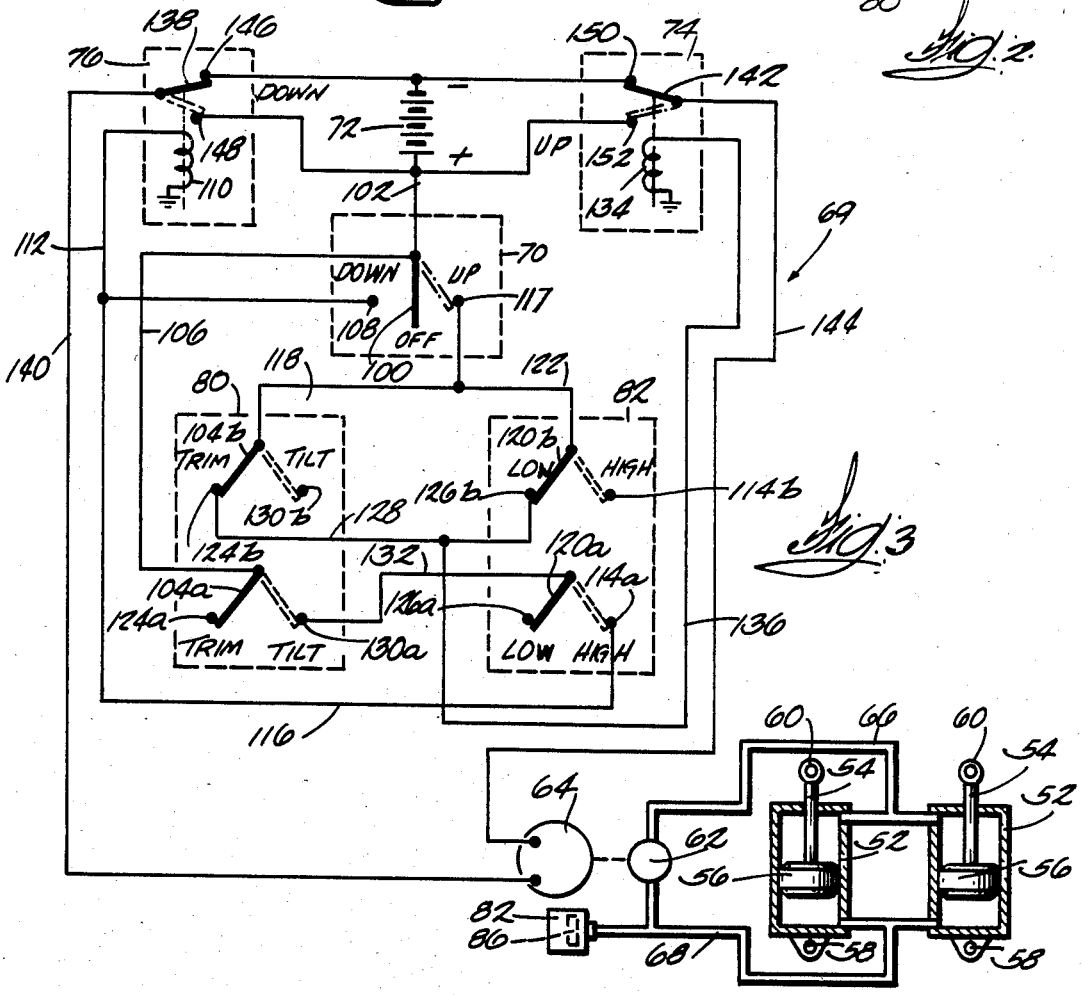
FIG. 3 is a schematic representation of the hydraulic system for the outboard motor shown in FIG. 1 and the electrical control for the hydraulic system.

Referred to FIG. 3, the hydraulic cylinders 52 are actuated by a conventional reversible pump 62 driven by a conventional reversible electric motor 64. The pump 62 is connected to a source of hydraulic fluid (not shown) and to the hydraulic cylinders 52, at locations on the opposite sides of the piston 56, via suitable respective conduits 66 and 68. When the pump 62 is rotated in one direction by the motor 62 and supplies pressurized hydraulic fluid through the conduit 68, the piston rods 54 are extended and the propulsion assembly 12 is initially pivoted about the trim axis 42 through a range of trim positions illustrated by angle A in FIG. 1, during which time the propeller 26 remains fully submerged in the water.

The propulsion assembly 12 is subsequently pivoted about the tilt axis 42 and eventually reaches the fully raised, non-operating position shown by dash lines in FIG. 1. When the pump 62 is rotated in the opposite direction by the motor 64 and supplies pressurized hydraulic fluid through the conduit 66, the piston rods 54 are retracted and the propulsion assembly 12 is pivoted downwardly about either the tilt axis 42 or the trim axis 46, depending on the location of the propulsion assembly 12 at the time operation of the pump 62 is started.

The outboard motor 10 also includes an electrical control 69 (FIG. 3) comprising means for controlling operation of the pump including a trim-tilt switch 70 which is movable between neutral or "off", "up" and "down" positions to selectively operate the pump 62, whereby the pump 62 is operated to cause retraction of the hydraulic cylinder piston rods 54 to pivot the propulsion assembly 12 downwardly in response to movement of the trim-tilt switch 70 to the "down" position, irrespective of propeller thrust or the angular position of the propulsion assembly 12. The pump 62 also is operated to cause extension of the hydraulic cylinder piston rods 54 to pivot the propulsion assembly 12 upwardly in response to movement of the trim-tilt switch 70 to the "up" position when the propeller thrust is below a predetermined level, irrespective of the angular position of the propulsion assembly 12, and to cause extension of the hydraulic cylinder piston rods 54 to pivot the propulsion assembly 12 upwardly in a trim position to a tilt position in response to movement of the trim-tilt switch 70 to the "up" position, except when the propeller thrust is above the predetermined level. The pump 62 is further operated to cause retraction of the hydraulic cylinder piston rods 54 to pivot the propulsion assembly 12 downwardly from a tilt position to a trim position when the propeller thrust exceeds the predetermined level, irrespective of the position of the trim-tilt switch.

The electrical control 69 will be described in connection with performing all three of the above functions with respect to selectively controlling the operation of the pump 62. However, it should be understood that the electrical control 69 can be arranged to perform one function independently, as well as any combination of these three functions.

While other arrangements can be used, in the specific construction illustrated, such the trim-tilt switch 70 is a conventional single pole, double throw switch which is movable between neutral or "off", "up" and "down" positions to selectively electrically connect an electrical power source, such as an electrical battery 72, to an "up" relay 74 and a "down" relay 76 which provide the corresponding operation of the motor 64, and thus the pump 62. As explained in more detail below, energization of the "up" relay 74 causes the pump 62 to be rotated in the direction which produces an extension of the hydraulic cylinder piston rods 54 and energization of the "down" relay 76 causes the pump 62 to be rotated in the opposite direction to retract the hydraulic cylinder piston rods 54.

Figure 2:
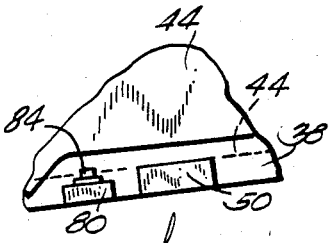
FIG. 2 is an enlarged framentary view of the position switch of the outboard motor shown in FIG. 1.

The electrical control 69 further includes a propulsion assembly position switch 80 and a propeller thrust switch 82 electrically connected in parallel between the trim-tilt switch 70 and the "up" and "down" relays 74 and 76. In the specific construction illustrated, the position switch 80 is a conventional double pole, double throw motion-actuated switch mounted on the stern bracket 38 (FIG. 2) and includes an actuation plunger 84 which, in response to being depressed, causes switching from one position to another. The position switch 80 is normally in a "trim" position and is switched to a "tilt" position in response to the plunger 84 being depressed.

The position switch 80 is positioned on the stern bracket 38 so that the plunger 84 is engaged and depressed by the swivel bracket 44 (as illustrated by the dashed line in FIG. 2) or a part thereon to cause switching from the "trim" position to the "tilt" position as the swivel bracket 44 is pivoted relative to the stern bracket 38 about the trim axis 46 and reaches or moves beyond the upper end of the range of the trim positions. The position switch 80 preferably is movably mounted on the stern bracket 34 in a manner so that the angular position of the propulsion assembly 12 at which the position switch 80 is actuated can be adjusted.

The thrust switch 82 is a conventional double pole, double throw pressure-actuated switch including a pressure sensing element 86 (shown schematically) which, in response to being exposed to hydraulic fluid pressure above a predetermined level, causes switching from one position to the other. The thrust switch 82 is normally in a "low" thrust position and is switched to a "high" thrust position in response to the pressure sensing element being exposed to hydraulic fluid above the predetermined level.

Forward thrust applied on the lower unit 18 by the propeller 26 tends to push the hydraulic cylinder piston rods 54 inwardly. Placement of the pistons 56 under load in the substantially incompressible hydraulic fluid causes an increase in the pressure of the hydraulic fluid in the portion of the hydraulic system in communication with the side of the pistons 56 opposite to the piston rods 54. This increased pressure corresponds to increased propeller thrust. The pressure sensing element 86 of the thrust switch 82 (FIG. 3) is connected in communication with the hydraulic system conduit 68 and, in response to the hydraulic fluid pressure exceeding a pressure corresponding to a predetermined propeller thrust level, causes the thrust switches 82 to switch from the "low" thrust position to the "high" thrust position.

Referring to FIG. 3, the electrical connections between the components of the electrical control 69 and the operation of the electrical control 69 will be described in more detail.

The switch arm 100 of the trim-tilt switch 70 is electrically connected to the battery 72 via a lead 102 and is electrically connected to one switch arm **104*a* of the position switch 80 via a lead 106. The "down" contact 108 of the trim-tilt switch 70 is electrically connected to the "down" relay coil 110 via a lead 112 and is electrically conntected to one "high" thrust contact 114*a* of the thrust switch 82 via a lead 116. The "up" contact 117 of the trim-tilt switch 70 is electrically connected to the other switch arm 104***b* of the position switch 80 via a lead 118 and is electrically connected to one switch arm 120*b* of the thrust switch 82 via a lead 122.

One of the "trim" contacts 124*b* of the position switch 80 is electrically connected to one of the "low" thrust contacts 126*b* of the thrust switch 82 via a lead 128. One of the "tilt" contacts 103*a* of the position switch 80 is electrically connected to the other switch arm 120*a* of the thrust switch 82 via a lead 132. Both the "trim" contact 124*b* of the position switch 80 and the "low" thrust contact 126*b* of the thrust switch 82 are electrically connected to the "up" relay coil 134 via a lead 136.

The "down" relay switch arm 138 is electrically connected to the motor 64 via a lead 140 and the "up" relay switch arm 142 is electrically connected by the motor 64 via a lead 144. The normally closed contact 146 and the normally open contact 148 of the "down" relay 76 are respectively electrically connected to the negative and positive poles of the battery 72. The normally closed contact 150 and the normally open contact 152 of the "up" relay 74 are respectively electrically connected to the negative and positive poles of the battery 72.

In operation, when the trim-tilt switch 70, the position switch 80 and the thrust switch 82 are in the positions illustrated by solid lines in FIG. 3, neither the "up" relay 74, nor the "down" relay 76, is energized and the propulsion assembly 12 remains in the existing trim position. If the trim-tilt switch 70 is moved to the "up" position (as illustrated by the dashed line in FIG. 3) with the position switch 80 in the "trim" position and the thrust switch 82 is the "low" thrust position (as illustrated by the solid lines in FIG. 3), electrical power is supplied from the battery 72 to the "up" relay coil 134 via the lead 102, the switch arm 100 of the trim-tilt switch 70, the lead 122, the switch arm 120*b* of the thrust switch and and the lead 136.

The "up" relay 74 is energized and the switch arm 142 is moved into engagement with the normally open contact 152 (as illustrated by the dashed line in FIG. 3). Electrical power is supplied from the battery 72 to the motor 64 via the "up" relay switch arm 142 and the lead 144. The pump 62 is rotated to extend the hydraulic cylinder piston rods 54 and pivot the propulsion assembly 12 upwardly until the trim-tilt switch 70 is moved to the "off" position or the piston rods 54 are fully extended.

If the trim-tilt switch 70 is moved to the "up" position (as illustrated by the dashed line in FIG. 3) with the position switch 80 in the "trim" position (as illustrated by the solid line in FIG. 3) and the thrust switch 82 in the "high" thrust position (as illustrated by the dotted line in FIG. 3), electrical power is supplied from the battery 72 to the "up" relay coil 134 via the lead 102, the switch arm 100 of the trim-tilt switch 70, the lead 118, the switch arm 104*b* of the position switch 80, and the lead 136.

The motor 64 is operated in the same manner as described above and the hydraulic cylinder piston rods 54 are extended until the propulsion assembly 12 reaches the end of the trim range, at which time the plunger 84 of the position switch 80 is depressed and the switch arms 104*a* and 104*b* of the position switch are moved into engagement with respective "tilt" contacts 130*a* and 130*b* (as illustrated by the dotted lines in FIG. 3). When this occurs, the electrical power to the "up" relay coil 134 is interrupted by virtue of the switch arm 104*b* of the position switch 80 disengaging from the "trim" contact 124*b*. Thus, the propulsion assembly 12 cannot be moved to a tilt position if the propeller thrust is above the predetermined level even though the trim-tilt switch 70 is moved to the "up" position.

If during operation, the propulsion assembly 12 has been moved to tilt position with the engine operating at relatively low speeds and the trim-tilt switch 70 is returned to the "off" position, neither the "up" relay 74 nor the "down" relay 76 will be energized. However, if the engine speed is increased sufficiently to cause the propeller thrust to exceed the predetermined level, the thrust switch 82 switches to the "high" thrust (as illustrated by the dotted lines in FIG. 3) in response to the increased hydraulic fluid pressure in the conduit 68. When this occurs, electrical power is supplied from the battery 72 to the "down" relay coil 110 via the lead 102, the lead 106, the switch arm 104*a* of the position switch 80, the lead 132, the switch arm 120*a* of the thrust switch 82 and the lead 116.

The "down" relay switch arm 138 is moved into engagement with the normally open contact 148 (as illustrated by the dotted line in FIG. 3) and electrical power is supplied from the battery 72 to the motor 64 via the switch arm 138 and the lead 140. The pump 62 is rotated to retract the hydraulic cylinder piston 54 and pivot the propulsion unit downwardly until the position switch 80 switches from the "tilt" to the "trim" position because the propulsion assembly 12 is moved to the trim range or until the thrust switch 82 switches from the "high" thrust position to the "low" thrust position because of a decrease in engine speed. Thus, the electrical control 69 causes the propulsion assembly 12 to be automatically moved from a tilt position to a trim position in the event the propeller thrust exceeds the predetermined level.

Rather than describing the operation of the motor 64 and the pump 62 for other positions of the trim-tilt switch 70, the position switch 80 and thrust switch 82, the initial movement of the propulsion assembly 12 for the various positions of these switches are tabulated below.

| Trim-Tilt Switch Position | Position Switch Position | Thrust Switch Position | Initial Movement of Propulsion Assembly |
|---|---|---|---|
| Off | Trim | Low | None |
| Off | Trim | High | None |
| Off | Tilt | Low | None |
| Off | Tilt | High | Down |
| Up | Trim | Low | Up |
| Up | Trim | High | Up |
| Up | Tilt | Low | Up |
| Up | Tilt | High | Down |
| Down | Trim | Low | Down |
| Down | Trim | High | Down |
| Down | Tilt | Low | Down |
| Down | Tilt | High | Down |

From this tabulation, it can be seen that the propulsion assembly 12 is pivoted downwardly in response to moving the trim-tilt switch 70 to the "down" position irrespective of the positions of the position switch 80 and the thrust switch 82. It also can be seen that the propulsion assembly is pivoted upwardly in response to moving the trim-tilt switch 70 to the "up" position, except when the propulsion assembly 12 is in a tilt position and the propeller thrust is above the predetermined level, in which case the propulsion assembly 12 is moved downwardly as described above. It further can be seen that, when the trim-tilt switch 70 is in the "off" position, the propulsion assembly 12 is not moved unless it is in a tilt position and the propeller thrust exceeds the predetermined level, in which case the propulsion assembly 12 is moved downwardly as described above.

While the electrical control 69 has been described in connection with an outboard motor including a swivel bracket pivotally connected to a stern bracket which in turn is pivotally connected to a transom bracket, it should be understood that it also is operable on stern drive units and outboard motors including a propulsion assembly supported by a swivel bracket directly attached to a transom bracket.

Various of the features of the invention are set forth in the following claims:

I claim:

1. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of trim positions from a fully down, operating position wherein said propeller is fully submerged in the water and also through a range of tilt positions angularly upwardly from the range of trim positions and including a fully raised, non-operating position, a hydraulic fluid system for actuating said hydraulic cylinder means including an electrically operated, reversible hydraulic pump which effects movement of said hydraulic cylinder means in a first direction to pivot said propulsion assembly downwardly in said vertical plane when pumping hydraulic fluid in one direction and which effects movement of said hydraulic cylinder means in a second direction to pivot said propulsion assembly upwardly in said vertical plane when pumping hydraulic fluid in the opposite direction, and electrical control means including a trim-tilt switch movable between off, up and down positions, said control means selectively operating said pump so as to cause downward pivotal movement of said propulsion assembly in said vertical plane in response to movement of said trim-tilt switch to the down position, irrespective of the level of thrust applied on said propulsion assembly by said propeller or the position of said propulsion assembly other than the fully down, operating position, to cause upward pivotal movement of said propulsion assembly in said vertical plane in response to movement of said trim-tilt switch to the up position when the propeller thrust is below a predetermined level, irrespective of the position of said propulsion assembly, to cause upward pivotal movement of said propulsion assembly to said vertical plane from a trim position to a tilt position in response to movement of said trim-tilt switch to the up position, except when the propeller thrust is above said predetermined level, and to cause downward pivotal movement of said propulsion assembly in said vertical plane from a tilt position to a trim position when the propeller thrust exceeds said predetermined level, irrespective of the position of said trim-tilt switch.

2. A marine propulsion device according to claim 1 wherein said hydraulic cylinder means includes a reciprocating piston which is placed under load in response to increasing propeller thrust and thereby causes the hydraulic pressure in one part of said hydraulic system to increase, and wherein said electrical control means includes a pressure-actuated thrust switch connected in pressure sensing relationship with said one part of said hydraulic system and movable from one switch position to another switch position in response to the hydraulic pressure exceeding a predetermined level corresponding to said predetermined propeller thrust level.

3. A marine propulsion device according to claim 1 wherein said electrical control means includes a motion-actuated position switch movable from one switch position to another switch position in response to said propulsion assembly being pivoted upwardly to said vertical plane past a predetermined angular position.

4. A marine propulsion device according to claim 1 wherein said means connecting said propulsion assembly and said transom bracket comprises a stern bracket having an upper end, first pivot means connecting said upper end of said stern bracket to said transom bracket for pivotal movement of said stern bracket relative to said transom bracket in said vertical plane about a generally horizontal transverse tilt axis, a swivel bracket, second pivot means connecting said swivel bracket to said stern bracket below said tilt axis for pivotal movement of said swivel bracket relative to said stern bracket in said vertical plane about a generally horizontal transverse trim axis parallel to said tilt axis, means connecting said propulsion assembly to said swivel bracket for steering movement of said propulsion assembly about a generally vertical axis and for common pivotal movement with said swivel bracket in said vertical plane about said trim and tilt axes, and wherein said hydraulic cylinder means sequentially pivots said swivel bracket and said propulsion assembly upwardly about said trim axis and then about said tilt axis and sequentially pivots said swivel bracket and said propulsion assembly downwardly about said tilt axis and then about said trim axis.

5. A marine propulsion device according to claim 1 wherein said hydraulic cylinder means includes a reciprocating piston which is placed under load in response to increasing propeller thrust and thereby causes the hydraulic pressure in one part of said hydraulic system to increase, and wherein said electrical control means includes an electrical power source, a trim-tilt switch movable between off, up and down positions, a motion-actuated position switch movable from a trim position to a tilt position in response to said propulsion assembly being pivoted upwardly past a predetermined angular position, a pressure-actuated thrust switch connected in pressure sensing relationship with said one part of said hydraulic system and movable from a low thrust position to a high thrust position in response to the hydraulic pressure exending a predetermined level corresponding to said predetermined propeller thrust level, an electrical motor for driving said pump and electrical circuit means electrically interconnecting said power source, said trim-tilt switch, said position switch, said thrust switch and said motor, whereby said pump is operated to cause downward pivotal movement of said propulsion assembly in response to movement of said trim-tilt switch to the down position, irrespective of the position of said position switch and said thrust switch, to cause upward pivotal movement of said propulsion assembly in response to movement of said trim-tilt switch to the up position, except when said position switch is in the tilt position and said thrust switch is in the high thrust position, and said pump is operated to cause downward pivotal movement of said propulsion assembly when said position switch is in the tilt position and said thrust switch is in the high thrust position irrespective of the position of the trim-tilt switch.

6. A marine propulsion device according to claim 5 wherein said position switch is located to switch from the trim position to the tilt position at an angle corresponding to the upper end of the range of trim positions.

7. A marine propulsion device according to claim 5 wherein said trim-tilt switch is a single pole, double throw switch including a down contact, an up contact and a first switch arm selectively movable into engagement with said up and down contact, wherein said position switch is a double pole, double throw switch including first and second trim contacts, first and second tilt contact, and second and third switch arms which are respectively engaged with said first and second trim contacts when said propulsion assembly is in a trim position and which are respectively engaged with said first and second contacts when said propulsion assembly is in a tilt position, wherein said thrust switch is a double pole double throw switch including first and second low thrust contacts, first and second high thrust contacts and fourth and fifth switch arms which are respectively engaged with said first and second low thrust contacts when the propeller thrust is below said predetermined level and which are respectively engaged with said first and second high thrust contacts when the propeller thrust is above said predetermined level, and wherein said electrical control further includes means electrically connecting said first switch arm with said third switch arm, electrically connecting said down contact with said second high thrust contact and said motor, electrically connecting said up contact with said second switch arm and said fourth switch arm, electrically connecting said first trim contact and first low thrust contact with each other and with said motor, and electrically connecting said second tilt contact with said fifth switch arm.

8. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of positions from a fully down, operating position wherein said propeller is fully submerged in the water to a fully raised, non-operating position, a hydraulic fluid system for actuating said hydraulic cylinder means including an electrically operated, reversible hydraulic pump which effects movement of said hydraulic cylinder means in a first direction to pivot said propulsion assembly downwardly in said vertical plane when pumping hydraulic fluid in one direction and which effects movement of said hydraulic cylinder means in a second direction to pivot said propulsion assembly upwardly in said vertical plane when pumping hydraulic fluid in the opposite direction, and electrical control means for selectively operating said pump and including a pressure-actuated thrust switch connected in pressure sensing relationship with said hydraulic system and movable from one switch position to another switch position in response to a hydraulic pressure level corresponding to a predetermined propeller thrust level, and a motion-actuated position switch movable from one switch position to another switch position in response to movement of said propulsion assembly in said vertical plane through a predetermined angular position.

9. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of positions from a fully down, operating position wherein said propeller is fully submerged in the water to a fully raised, non-operating position, a hydraulic fluid system for actuating said hydraulic cylinder means including an electrically operated, reversible hydraulic pump which effects movement of said hydraulic cylinder means in a first direction to pivot said propulsion assembly downwardly in said vertical plane when pumping hydraulic fluid in one direction and which effects movement of said hydraulic cylinder means in a second direction to pivot said propulsion assembly upwardly in said vertical plane when pumping hydraulic fluid in the opposite direction, a pressure actuated thrust switch connected in pressure sensing relationship with said hydraulic system and movable from one switch position to another switch position in response to a hydraulic pressure level associated with propeller thrust above a predetermined level, and electrical control means connected to said thrust switch for selectively operating said pump so as to cause upward pivotal movement of said propulsion assembly in said vertical plane to any position at or below said fully raised position when the thrust applied on said propulsion assembly by said propeller is below said predetermined level, and to cause limited upward pivotal movement of said propulsion assembly in said vertical plane to a preselected position below said fully raised position when the propeller thrust is above said predetermined level.

10. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of trim positions from a fully down, operating position wherein said propeller is fully submerged in the water and also through a range of tilt positions angularly upwardly from the range of trim positions and including a fully raised, non-operating position, a hydraulic fluid system for actuating said hydraulic cylinder means including an electrically operated, reversible hydraulic pump which effects movement of said hydraulic cylinder means in a first direction to pivot said propulsion assembly downwardly in said vertical plane when pumping hydraulic fluid in one direction and which effects movement of said hydraulic cylinder means in a second direction to pivot said propulsion assembly upwardly in said vertical plane when pumping hydraulic fluid in the opposite direction, and electrical control means including a trim-tilt switch movable between off, up and down positions, said control means being operable selectively to operate said pump so as to cause downward pivotal movement of said propulsion assembly in said vertical plane from a tilt position to a trim position when the thrust applied on said propulsion assembly exceeds a predetermined level, irrespective of the position of said trim-tilt switch.

11. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of positions from a fully down, operating position wherein said propeller is fully submerged in the water to a fully raised, non-operating position, a hydraulic fluid system for actuating said hydraulic cylinder means including an electrically operated, reversible hydraulic pump which effects movement of said hydraulic cylinder means in a first direction to pivot said propulsion assembly downwardly in said vertical plane when pumping hydraulic fluid in one direction and which effects movement of said hydraulic cylinder means in a second direction to pivot said propulsion assembly upwardly in said vertical plane when pumping hydraulic fluid in the opposite direction, and electrical control means for selectively operating said pump so as to cause downward pivotal movement of said propulsion assembly in said vertical plane irrespective of the level of thrust applied on said propulsion assembly by said propeller or the position of said propulsion assembly other than the fully down, operating position, to cause upward pivotal movement of said propulsion assembly in said vertical plane irrespective of the position of said propulsion assembly when the propeller thrust is below a predetermined level, and to cause upward pivotal movement of said propulsion assembly in said vertical plane to a preselected position below said fully raised position when the propeller thrust is above said predetermined level, said control means including a pressure-actuated thrust switch connected in pressure sensing relationship with said hydraulic system and movable from one switch position to another switch position in response to a hydraulic pressure level corresponding to said predetermined propeller thrust level, and a motion-actuated position switch movable from one switch position to another switch position in response to said propulsion assembly being pivoted through said preselected position.

12. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of trim positions from a fully down, operating position wherein said propeller is fully submerged in the water and also through a range of tilt positions angularly upwardly from the range of trim positions and including a fully raised, non-operating position, a hydraulic fluid system for actuating said hydraulic cylinder means including an electrically operated, reversible hydraulic pump which effects movement of said hydraulic cylinder means in a first direction to pivot said propulsion assembly downwardly in said vertical plane when pumping hydraulic fluid in one direction and which effects movement of said hydraulic cylinder means in a second direction to pivot said propulsion assembly upwardly in said vertical plane when pumping hydraulic fluid in the opposite direction, and electrical control means for selectively operating said pump so as to cause downward pivotal movement of said propulsion assembly in said vertical plane irrespective of the level of thrust applied on said propulsion assembly or the position of said propulsion assembly other than the fully down, operation position, and to cause downward pivotal movement of said propulsion assembly in said vertical plane from a tilt position to a trim position when the propeller thrust is above said predetermined level.

13. A marine propulsion device comprising a transom bracket adapted to be connected to a boat transom, a propulsion assembly including a lower unit which carries a rotatably mounted propeller and which is submerged in water said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of trim positions from a fully down, operating position wherein said propeller is fully submerged in the water and also through a range of tilt positions angularly upwardly from the range of trim positions and including a fully raised, non-operating position, a hydraulic fluid system for actuating said hydraulic cylinder means including an electrically operated, reversible hydraulic pump which effects movement of said hydraulic cylinder means in a first direction to pivot said propulsion assembly downwardly in said vertical plane when pumping hydraulic fluid in one direction and which effects movement of said hydraulic cylinder means in a second direction to pivot said propulsion assembly upwardly in said vertical plane when pumping hydraulic fluid in the opposite direction, and electrical control means for selectively operating said pump so as to cause upward pivotal movement of said propulsion assembly in said vertical plane when the thrust applied on said propulsion assembly by said propeller is below a predetermined level irrespective of the position of said propulsion assembly, to cause upward pivotal movement of said propulsion assembly in said vertical plane from a trim position to a tilt position except when the propeller thrust is above said predetermined level, and to cause downward pivotal movement of said propulsion assembly in said vertical plane from a tilt position to a trim position when the propeller thrust exceeds said predetermined level.

14. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of positions from a fully down, operating position wherein said propeller is fully submerged in the water to a fully raised, non-operating position, a hydraulic fluid system for actuating said hydraulic cylinder means including an electrically operated, reversible hydraulic pump which effects movement of said hydraulic cylinder means in a first direction to downwardly pivot said propulsion assembly in said vertical plane when pumping hydraulic fluid in one direction and which effects movement of said hydraulic cylinder means in a second direction to upwardly pivot said propulsion assembly in said vertical plane when pumping hydraulic fluid in the opposite direction, and electrical control means for selectively operating said pump and including a pressure-actuated thrust switch connected in pressure sensing relationship with said hydraulic system and movable from one switch position to another switch position in response to a hydraulic pressure level associated with propeller thrust above a predetermined level.

15. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of positions from a fully down, operating position wherein said propeller is fully submerged in the water to a fully raised, non-operating position, a hydraulic fluid system for actuating said hydraulic cylinder means including an electrically operated, reversible hydraulic pump which effects movement of said hydraulic cylinder means in a first direction to pivot downwardly said propulsion assembly in said vertical plane when pumping hydraulic fluid in one direction and which effects movement of said hydraulic cylinder means in a second direction to pivot upwardly said propulsion assembly in said vertical plane when pumping hydraulic fluid in the opposite direction, and electrical control means for selectively operating said pump and including a double throw, motion-actuated position switch movable from one switch position to another switch position in response to movement of said propulsion assembly in said vertical plane through a predetermined angular position below the fully raised position.

16. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of trim positions from a fully down, operating position wherein said propeller is fully submerged in the water and also through a range of tilt positions angularly upwardly from the range of trim positions and including a fully raised, non-operating position, a hydraulic fluid system for actuating said hydraulic cylinder means including an electrically operated, reversible hydraulic pump which effects movement of said hydraulic cylinder means in a first direction to downwardly pivot said propulsion assembly in said vertical plane when pumping hydraulic fluid in one direction and which effects movement of said hydraulic cylinder means in a second direction to upwardly pivot said propulsion assembly in said vertical plane when pumping hydraulic fluid in the opposite direction, and electrical control means for selectively operating said pump so as cause downward pivotal movement of said propulsion assembly in said vertical plane from a tilt position to a trim position when the thrust applied on said propulsion assembly exceeds a predetermined level.

17. A marine propulsion device according to claim 16 wherein said electrical control means includes a pressure-actuated thrust switch connected in pressure sensing relationship with said hydraulic system and movable from one switch position to another switch position in response to the hydraulic pressure exceeding a predetermined level corresponding to said predetermined propeller thrust level.

18. A marine propulsion device according to claim 16 wherein said electrical control means includes a motion-actuated position switch movable from one switch position to another switch position in response to said propulsion assembly being pivoted upwardly in said vertical plane past a predetermined angular position.

19. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of trim positions from a fully down, operating position wherein said propeller is fully submerged in the water and also through a range of tilt positions angularly upwardly from the range of trim positions and including a fully raised, non-operating position, a hydraulic fluid system for actuating said hydraulic cylinder means including an electrically operated, reversible hydraulic pump which effects movement of said hydraulic cylinder means in a first direction to downwardly pivot said propulsion assembly in said vertical plane when pumping hydraulic fluid in one direction and which effects movement of said hydraulic cylinder means in a second direction to upwardly pivot said propulsion assembly in said vertical plane when pumping hydraulic fluid in the opposite direction, and electrical control means for selectively operating said pump so as to cause upward pivotal movement of said propulsion assembly in said vertical plane when the propeller thrust is below a predetermined level irrespective of the position of said propulsion assembly, and to cause downward pivotal movement of said propulsion assembly in said vertical plane from a tilt position to a trim position when the propeller thrust exceeds said predetermined level.

20. A marine propulsion device according to claim 19 wherein said electrical control means includes a pressure-actuated thrust switch connected in pressure sensing relationship with said hydraulic system and movable from one switch position to another switch position in response to the hydraulic pressure exceeding a predwtermined level corresponding to said predetermined propeller thrust level.

21. A marine propulsion device according to claim 19 wherein said electrical control means includes a motion-actuated position switch movable from one switch position to another switch position in response to said propulsion assembly being pivoted upwardly in said vertical plane past a predetermined angular position.

22. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of trim positions from a fully down, operating position wherein said propeller is fully submerged in the water and also through a range of tilt positions angularly upwardly from the range of trim positions and including a fully raised, non-operating position, a hydraulic fluid system for actuating said hydraulic cylinder means including an electrically operated, reversible hydraulic pump which effects movement of said hydraulic cylinder means in a first direction to downwardly pivot said propulsion assembly in said vertical plane when pumping hydraulic fluid in one direction and which effects movement of said hydraulic cylinder means in a second direction to upwardly pivot said propulsion assembly in said vertical plane when pumping hydraulic fluid in the opposite direction, and electrical control means for selectively operating said pump so as to cause upward pivotal movement of said propulsion assembly in said vertical plane from a trim position to a tilt position except when the propeller thrust is above a predetermined level, and to cause downward pivotal movement of said propulsion assembly in said vertical plane from a tilt position to a trim position when the propeller thrust exceeds said predetermined level.

23. A marine propulsion device according to claim 22 wherein said electrical control means includes a pressure-actuated thrust switch connected in pressure sensing relationship with said hydraulic system and movable from one switch position to another switch position in response to the hydraulic pressure exceeding a predetermined level corresponding to said predetermined propeller thrust level.

24. A marine propulsion device according to claim 22 wherein said electrical control means includes a motion-actuated position switch movable from one switch position to another switch position in response to said propulsion assembly being pivoted upwardly in said vertical plane past a predetermined angular position.

25. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of trim positions from a fully down, operating position wherein said propeller is fully submerged in the water and also through a range of tilt positions angularly upwardly from the range of trim positions and including a fully raised, non-operating position, a hydraulic fluid system for actuating said hydraulic cylinder means including an electrically operated, reversible hydraulic pump which effects movement of said hydraulic cylinder means in a first direction to downwardly pivot said propulsion assembly in said vertical plane when pumping hydraulic fluid in one direction and which effects movement of said hydraulic cylinder means in a second direction to upwardly pivot said propulsion assembly in said vertical plane when pumping hydraulic fluid in the opposite direction, and electrical control means for selectively operating said pump so as to cause downward pivotal movement of said propulsion assembly in said vertical plane irrespective of the level of thrust applied on said propulsion assembly by said propeller or the position of said propulsion assembly other than the fully down, operating position, to cause upward pivotal movement of said propulsion assembly in said vertical plane when the propeller thrust is below a predetermined level irrespective of the position of said propulsion assembly, and to cause downward pivotal movement of said propulsion assembly in said vertical plane from a tilt position to a trim position when the propeller thrust exceeds said predetermined level.

26. A marine propulsion device according to claim 25 wherein said electrical control means includes a pressure-actuated thrust switch connected in pressure sensing relationship with said hydraulic system and movable from one switch position to another switch position in response to the hydraulic pressure exceeding a predetermined level corresponding to said predetermined propeller thrust level.

27. A marine propulsion device according to claim 25 wherein said electrical control means includes a motion-actuated position switch movable from one switch position to another switch position in response to said propulsion assembly being pivoted upwardly in said vertical plane past a predetermined angular position.

28. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of trim positions from a fully down, operating position wherein said propeller is fully submerged in the water and also through a range of tilt positions angularly upwardly from the range of trim positions and including a fully raised, non-operating position, a hydraulic fluid system for actuating said hydraulic cylinder means including an electrically operated, reversible hydraulic pump which effects movement of said hydraulic cylinder means in a first direction to downwardly pivot said propulsion assembly in said vertical plane when pumping hydraulic fluid in one direction and which effects movement of said hydraulic cylinder means in a second direction to upwardly pivot said propulsion assembly in said vertical plane when pumping hydraulic fluid in the opposite direction, and electrical control means for selectively operating said pump so as to cause downward pivotal movement of said propulsion assembly in said vertical plane irrespective of the level of thrust applied on said propulsion assembly by said propeller or the position of said propulsion assembly other than the fully down, operating position, to cause upward pivotal movement of said propulsion assembly in said vertical plane from a trim position to a tilt position except when the propeller thrust is above a predetermined level, and to cause downward pivotal movement of said propulsion assembly in said vertical plane from a tilt position to a trim position when the propeller thrust exceeds said predetermined level.

29. A marine propulsion device according to claim 28 wherein said electrical control means includes a pressure-actuated thrust switch connected in pressure sensing relationship with said hydraulic system and movable from one switch position to another switch position in response to the hydraulic pressure exceeding a predetermined level corresponding to said predetermined propeller thrust level.

30. A marine propulsion device according to claim 28 wherein said electrical control means includes a motion-actuated position switch movable from one switch position to another switch position in response to said propulsion assembly being pivoted upwardly in said vertical plane past a predetermined angular position.

31. A marine propulsion device comprising a transom bracket adapted to be connected to a boat transom, a propulsion assembly including a lower unit which carries a rotatably mounted propeller and which is submerged in water when said propulsion assembly is in an operating position, means connecting said propulsion assembly and said transom bracket to afford relative pivotal movement of said propulsion assembly in a generally vertical plane, hydraulic cylinder means for pivoting said propulsion assembly in said vertical plane through a range of positions from a fully down, operating position wherein said propeller is fully submerged in the water to a fully raised, non-operating position, a hydraulic fluid system for actuating said hydraulic cylinder means including an electrically operated, reversible hydraulic pump which effects movement of said hydraulic cylinder means in a first direction to downwardly pivot said propulsion assembly in said vertical plane when pumping hydraulic fluid in one direction and which effects movement of said hydraulic cylinder means in a second direction to upwardly pivot said propulsion assembly in said vertical plane when pumping hydraulic fluid in the opposite direction, and electrical control means for selectively operating said pump so as to cause upward pivotal movement of said propulsion assembly in said vertical plane to a preselected position below said fully raised position and to prevent upward pivotal movement of said projection unit in said vertical plane beyond said preselected position below said fully raised position when the propeller thrust is above said predetermined level.

32. A marine propulsion device according to claim 31 wherein said electrical control means includes a pressure-actuated thrust switch connected in pressure sensing relationship with said hydraulic system and movable from one switch position to another switch position in response to the hydraulic pressure exceeding a predetermined level corresponding to said predetermined propeller thrust level.

33. A marine propulsion device according to claim 31 wherein said electrical control means includes a motion-actuated position switch movable from one switch position to another switch position in response to said propulsion assembly being pivoted upwardly in said vertical plane past a predetermined angular position.

* * * * *